US006195051B1

(12) United States Patent
McCoy et al.

(10) Patent No.: US 6,195,051 B1
(45) Date of Patent: Feb. 27, 2001

(54) MICROSTRIP ANTENNA AND METHOD OF FORMING SAME

(75) Inventors: Danny O. McCoy, Davie; Antonio Faraone, Plantation, both of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/548,486

(22) Filed: Apr. 13, 2000

Related U.S. Application Data

(62) Division of application No. 09/287,900, filed on Apr. 7, 1999.

(51) Int. Cl.[7] ..... H01Q 1/38
(52) U.S. Cl. ..... 343/700 MS; 343/846

(58) Field of Search ..... 343/700 MS, 846, 343/848

(56) References Cited

U.S. PATENT DOCUMENTS 4,899,164 * 2/1990 McGrath ..... 343/754
5,986,606 * 11/1999 Kossiavas et al. ..... 343/700 MS

* cited by examiner

*Primary Examiner*—Don Wong
*Assistant Examiner*—James Clinger
(74) *Attorney, Agent, or Firm*—Barbara R. Doutre

(57) ABSTRACT

A microstrip antenna (300) includes a substrate (302) having an inner ground plane layer (322) around which a radiator element is folded so as to form first and second radiator patches (310, 312) on either side of the ground plane.

11 Claims, 8 Drawing Sheets

MICROSTRIP ANTENNA AND METHOD OF FORMING SAME

This application is a Division of Ser. No. 09/287,900 filed Apr. 7, 1999.

TECHNICAL FIELD

This invention relates in general to antennas and more specifically to microstrip antennas.

BACKGROUND

There is a continuing interest among consumers for very small, lightweight communications products, such as cellular telephones, pagers, and lap top computers. Product requirements for these systems typically call for small low cost antennas. Microstrip antennas have been used to accommodate these small design requirements, because they can be fabricated using inexpensive printed circuit board technology. Over the years, many forms of microstrip antennas have been developed, the "patch" antenna being one of the most popular. FIGS. 1 and 2 show top and side views respectively of a typical patch antenna 100. Patch antenna 100 includes a rectangular shaped radiator element 102 disposed onto a substrate 104 over a ground plane 106 and coupled to a radio frequency (RF) feed 108.

The single rectangular patch 102 is characterized by a resonant electrical length (along length 110) characterized by equation:

$$L \approx \frac{c}{2f\sqrt{\varepsilon_r}},$$

where c is the speed of light, f is the resonant frequency, and $\epsilon_r$ is the dielectric constant of the substrate. However, the prior art antenna radiates in only one hemisphere away from the ground plane.

An example of an antenna which radiates in more than one hemisphere is the loop antenna, however, a loop antenna typically sits perpendicular to the product surface or suffers the consequences of being detuned.

It would be advantageous to have a microstrip antenna that could provide radiation coverage in both hemispheres. Such an antenna would be beneficial in both portable communications products and infrastructure apparatus.

DETAILED DESCRIPTION OF THE PREFERRED EMBODIMENT

Figure 1:
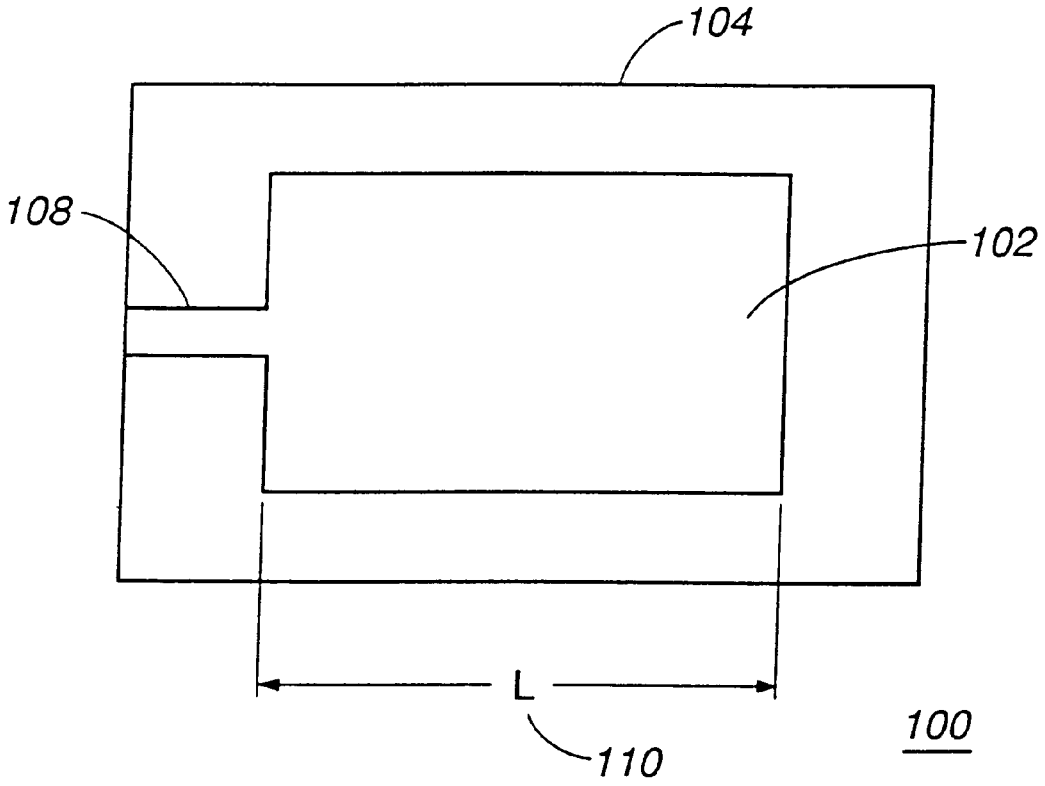
FIG. 1 (PRIOR ART)
FIG. 1 is a prior art patch antenna.
Figure 2:
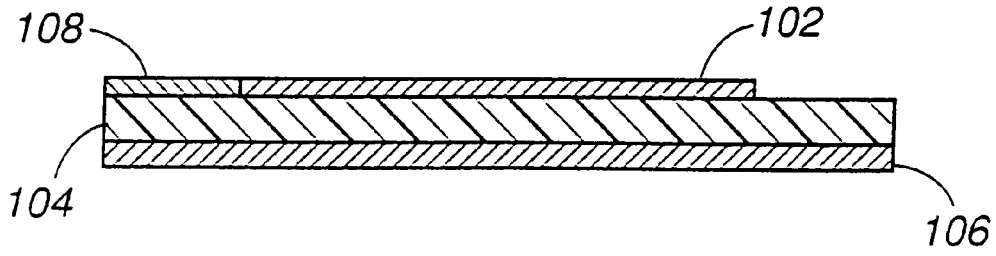
FIG. 2 (PRIOR ART)
FIG. 2 is a side view of the prior art patch antenna of FIG. 1.
Figure 3:
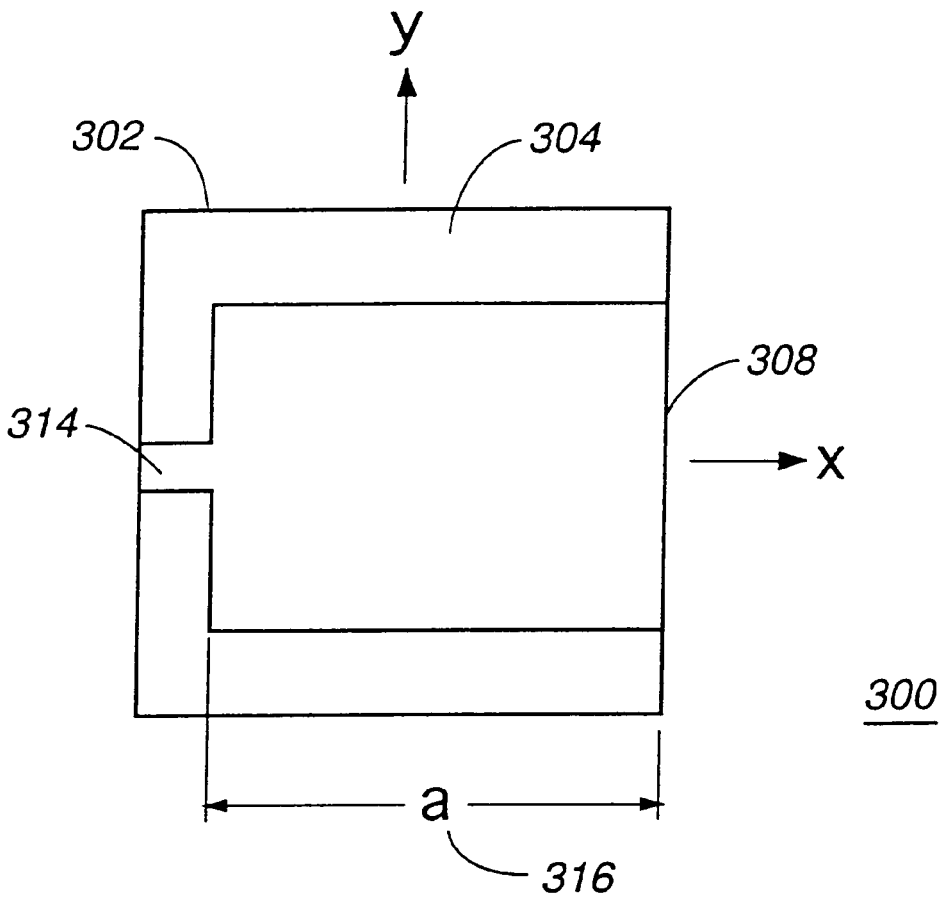
FIG. 3 is a microstrip antenna formed in accordance with the present invention.
Figure 4:
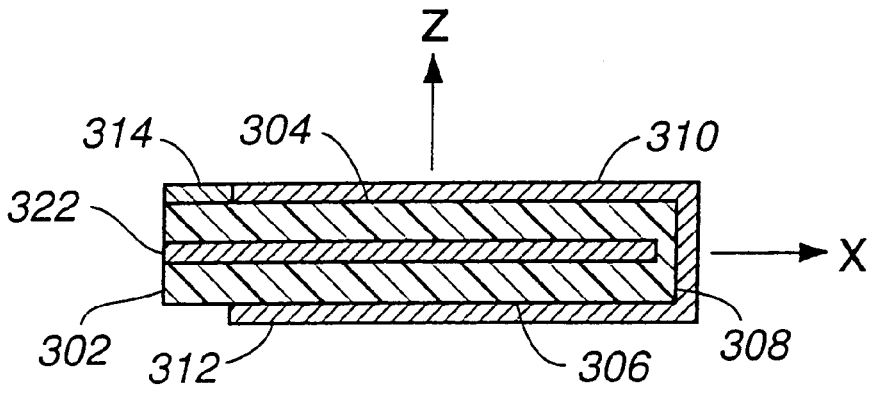
FIG. 4 is a side view of the antenna of FIG. 3 in accordance with the present invention.

FIGS. 3 and 4 show top and side views of a microstrip antenna structure 300 formed in accordance with the present invention. Antenna structure 300 includes a substrate 302 having top, bottom, and edge surfaces 304, 306, 308 respectively and includes an inner ground layer 322 formed herein. In accordance with the present invention, first and second radiator elements 310, 312 are disposed onto the top and bottom substrate surfaces 304, 306 over the inner ground plane layer 322 and are coupled along edge 308.

In accordance with the preferred embodiment of the invention, the first and second radiator elements 310, 312 are formed of first and second quarter wavelength patches coupled together along edge 308 to provide spherical coverage. This interconnection can be formed in a variety of ways including but not limited to, capacitive coupling, conductive paint, pins, vias, as well as other conductive interconnect mechanisms and electro-optical switches. Thus, the first and second radiator elements 310, 312 coupled together form a single radiator element which is disposed on opposite sides of the substrate 302 above and below the ground plane 322. The radiator elements 310, 312 are formed of a conductive material, such as copper, and deposited onto the substrate preferably using conventional printed circuit board techniques. Alternatively, a single half wavelength radiator element in the form of a rectangular patch can be folded around the edge 308 of the substrate 302 so as to form the first and second quarter wave patches 310, 312 on either side of the inner layer ground plane 322.

Antenna 300 further includes a feed 314 coupled to one of the patches (here shown as patch 310) to transfer a radio frequency (RF) signal to and from the antenna 300. The feed 314 can be coupled to the radiator patch 310 using a variety of coupling mechanisms including, but not limited to, capacitive coupling, coaxial coupling, microstrip, or other appropriate signal interface means. The feed 314 is preferably coupled to the radiating edge of the patch 310, but can also be coupled to other edges of the patch as well.

The resonant length of antenna 300 is characterized along the equal sides 316 by equation:

$$a \approx \frac{1}{4}\frac{c}{f\sqrt{\varepsilon_r}} \approx \frac{L}{2},$$

where c is the speed of light, f is the resonance frequency, and $\epsilon_r$ is the dielectric constant of the substrate.

Figure 5:
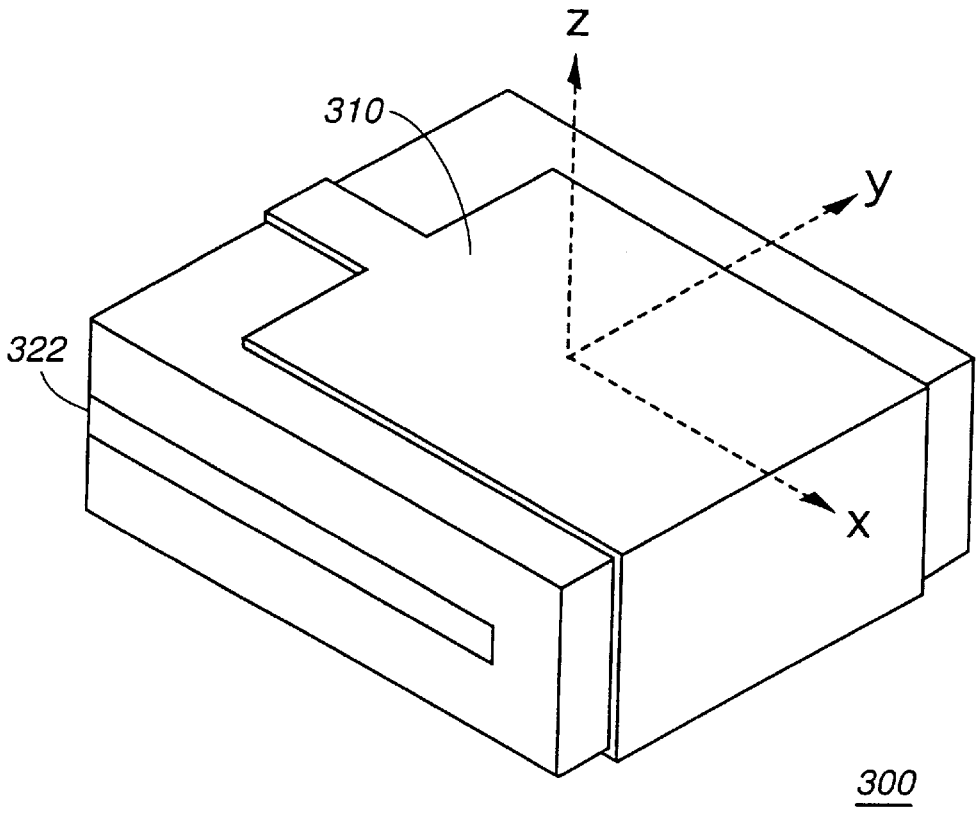
FIG. 5 is an isometric view of the antenna of FIG. 3 in accordance with the present invention (referenced to an X, Y, Z reference frame).

FIG. 5 is an isometric view of the antenna 300 of the present invention (referenced to an X, Y, Z reference frame). The antenna 300 can be formed of a variety of substrate materials, RF feed mechanisms, and conductive materials to provide an antenna structure best suited to a particular application. Using two quarter wave patches as the radiator elements 310, 312 coupled together on opposite surfaces of the ground plane 322, as described by the invention, provides an antenna 300 that radiates in both hemispheres while keeping the overall structure small enough for portable product applications.

As an example, measured experimental data was taken on an antenna formed in accordance with the preferred embodiment of the invention. For this example a single patch was folded around a substrate made of a composite ceramic material having a dielectric constant of $\epsilon_r$=4. The substrate measured length (in centimeters -cm) 5 cm, width=5 cm, and height 0.3 cm (all dimensions given are approximate). The two radiator patches each measured approximately 6 square cm, and a ground plane was sandwiched therebetween. For this example, the patches were dimensioned to provide a resonant frequency of approximately 1.45 gigahertz (GHz).

Figure 6C:
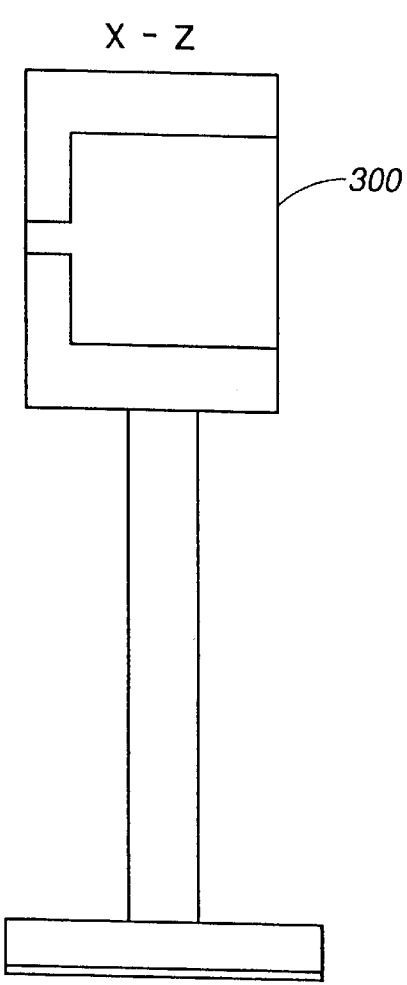
FIG. 6C shows an experimental set up for sampling the radiation pattern of the antenna of the present invention across the X-Z plane.
Figure 6B:
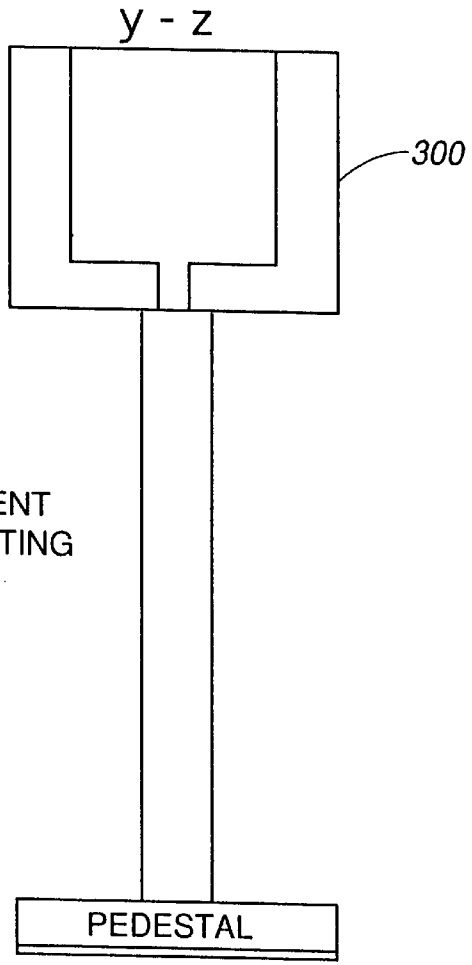
FIG. 6B shows an experimental set up for sampling the radiation pattern of the antenna of the present invention across the Y-Z plane.
Figure 6A:
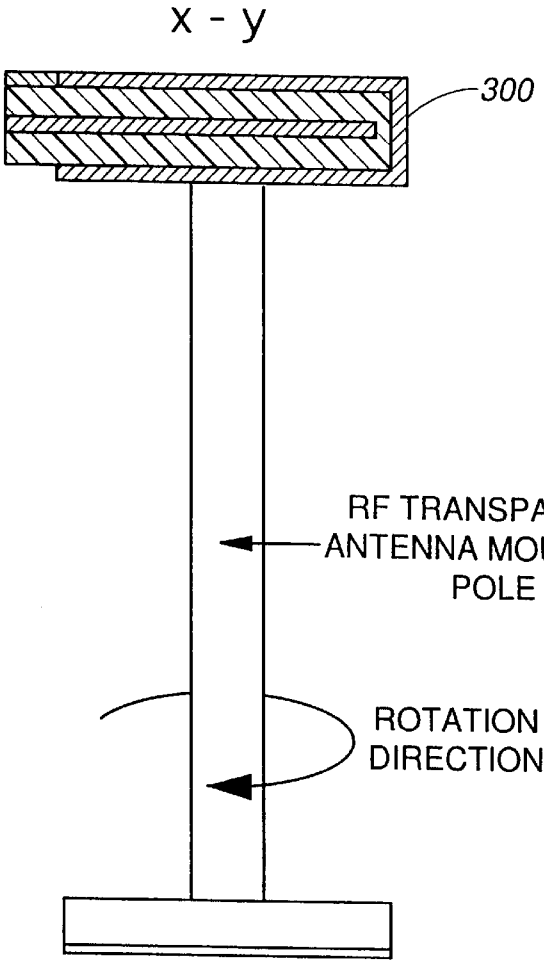
FIG. 6A shows an experimental set up for sampling the radiation pattern of the antenna of the present invention across the X-Y plane.

FIGS. 6A, 6B, and 6C show the antenna of the present invention mounted on a test pedestal used to position the antenna in order to measure the radiation pattern across the principal planes.

Figure 7A:
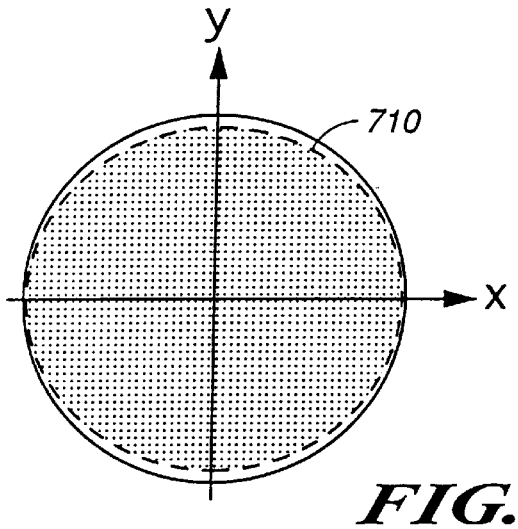
FIG. 7A shows a graphical representation of an approximation of a radiation pattern for the antenna of the preferred embodiment measured in the X-Y plane with the E-field polarization orthogonal to said plane.

FIG. 6A shows the antenna 300 mounted to measure the radiation pattern in the x-y plane. Substantially uniform radiation was measured with the orthogonal polarization and negligible radiation was measured in the parallel polarization. FIG. 7A is a graphical representation approximating the measured data for this position with curve 710 representing the radiation pattern for the orthogonal polarization.

Figure 7B:
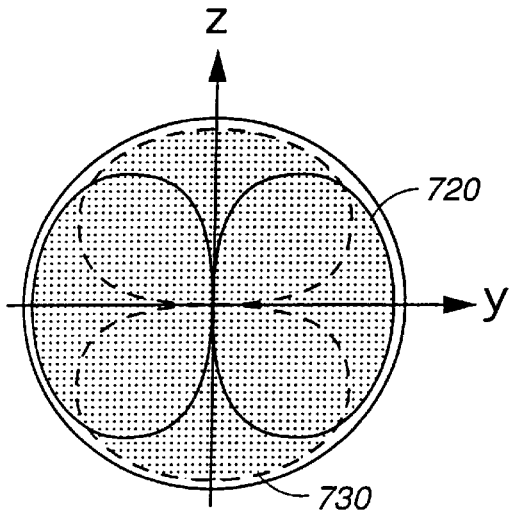
FIG. 7B shows a graphical representation of an approximation of a radiation pattern for the antenna of the preferred embodiment measured in the Y-Z plane with the E-field polarization orthogonal (dashed line) to and parallel (solid line) to said plane.

FIG. 6B shows the antenna 300 mounted to measure the radiation pattern in the y-z plane. The radiation pattern measured in this orientation was measured both with the parallel and orthogonal polarizations with respect to the y-z plane resulting in at least one of the corresponding field components being received at any angular position in this plane. FIG. 7B is a graphical representation approximating the measured data with curve 720 representing the radiation pattern for parallel polarization and curve 730 representing the radiation pattern for orthogonal polarization.

Figure 7C:
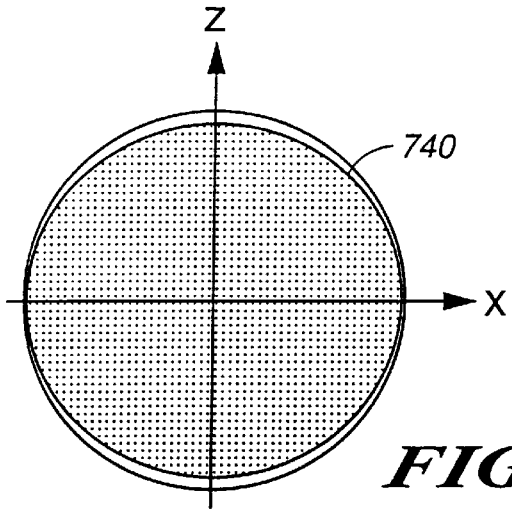
FIG. 7C shows a graphical representation of an approximation of a radiation pattern for the antenna of the preferred embodiment measured in the X-Z plane with the E-field polarization parallel to said plane.

FIG. 6C shows antenna 300 mounted to measure radiation in x-z orientation. A substantially uniform radiation pattern was measured in the parallel polarization with respect to the x-z plane and negligible radiation (not shown) was observed in the orthogonal polarization. FIG. 7C is a graphical representation approximating the measured data with curve 740 representing the radiation pattern for the parallel polarization.

Figure 8A:
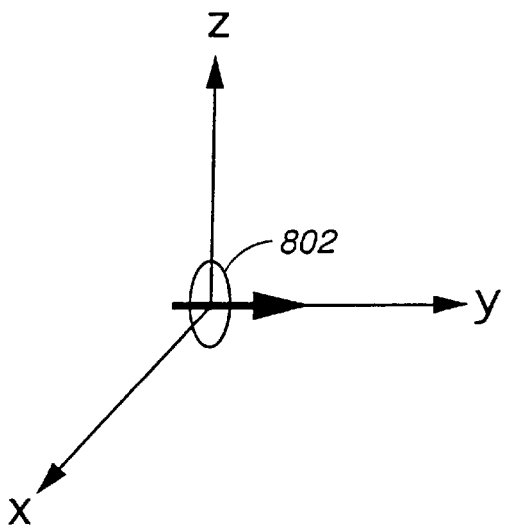
FIG. 8A is a representation of a loop antenna across an X-Z plane modeled as a magnetic current element directed along the y-axis.
Figure 8B:
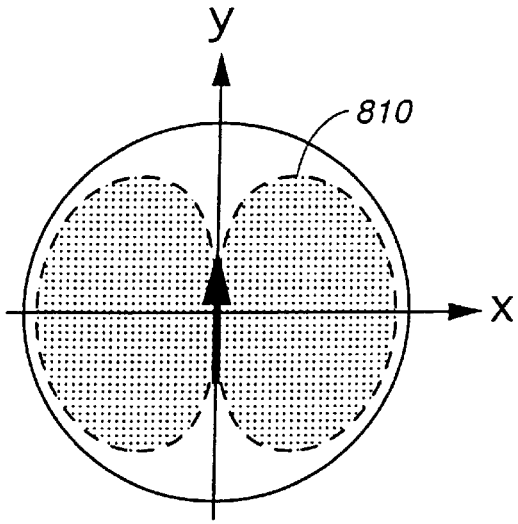
FIG. 8B (PRIOR ART)
FIG. 8B shows a graphical representation of a radiation pattern across the X-Y plane for the loop antenna of FIG. 8A
Figure 8C:
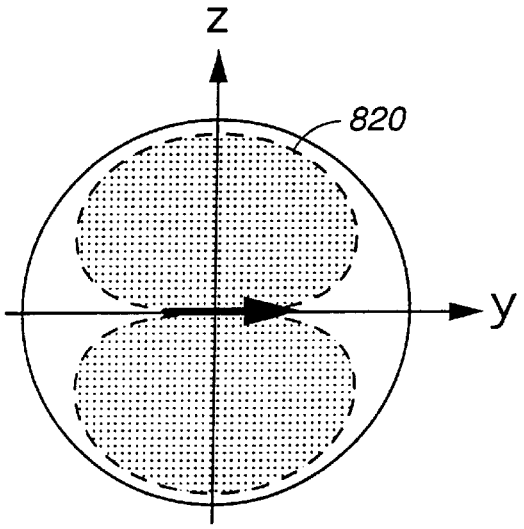
FIG. 8C (PRIOR ART)
FIG. 8C shows a graphical representation of a radiation pattern across the Y-Z plane for the loop antenna of FIG. 8A.
Figure 8D:
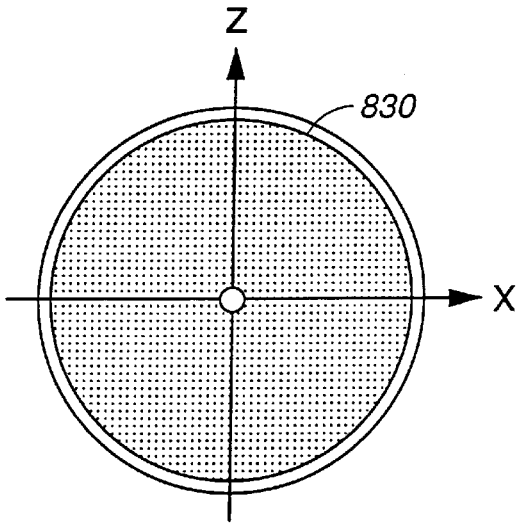
FIG. 8D (PRIOR ART)
FIG. 8D shows a graphical representation of a radiation pattern across the X-Z plane for the loop antenna of FIG. 8A.
Figure 9A:
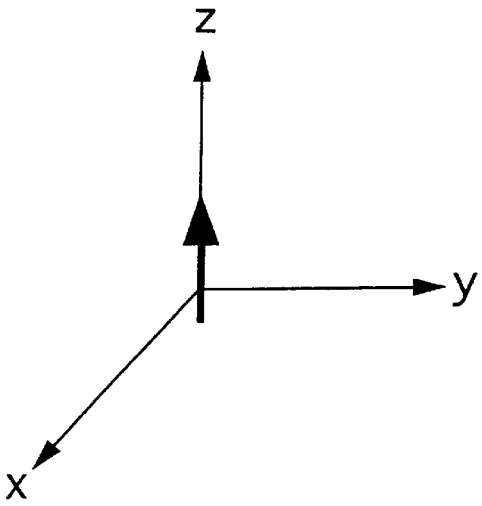
FIG. 9A is a representation of a dipole oriented along the z-axis.
Figure 9B:
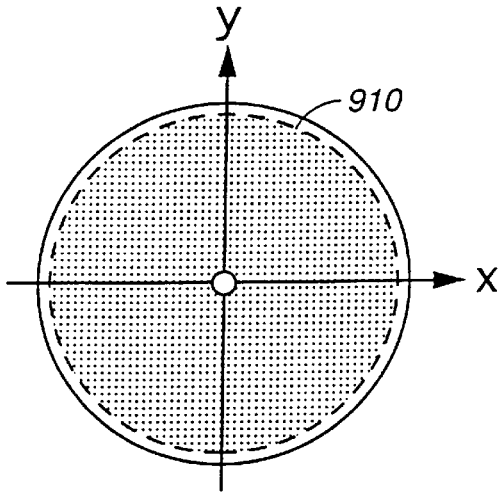
FIG. 9B (PRIOR ART)
FIG. 9B shows a graphical representation of a radiation pattern across the X-Y plane for the antenna of FIG. 9A.
Figure 9C:
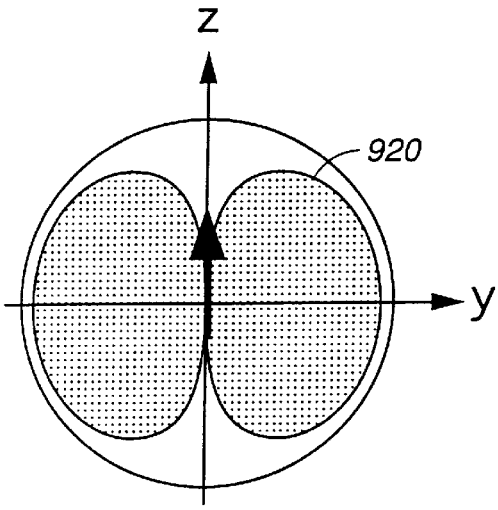
FIG. 9C (PRIOR ART)
FIG. 9C shows a graphical representation of a radiation pattern across the Y-Z plane for the antenna of FIG. 9A.
Figure 9D:
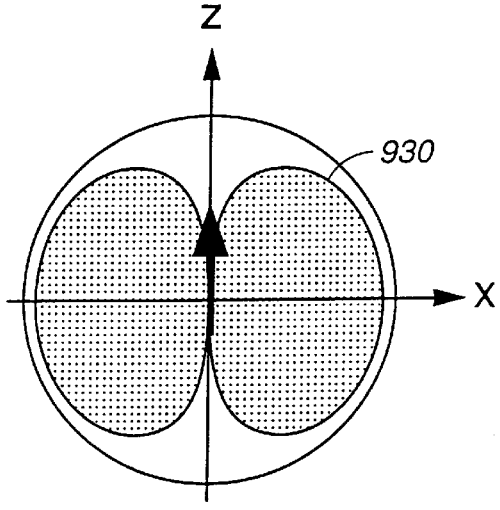
FIG. 9D (PRIOR ART)
FIG. 9D shows a graphical representation of a radiation pattern across the X-Z plane for the antenna of FIG. 9A.

When FIGS. 7A, 7B, and 7C are compared to graphical representations of radiation patterns for a loop antenna and radiation patterns for a dipole antenna, the improvement in coverage can be seen. FIG. 8A is a representation of a loop antenna 802 across an X-Z plane modeled as a magnetic current element directed along the y-axis. FIGS. 8B, 8C, and 8D show radiation patterns for the prior art loop antenna of FIG. 8A. FIG. 9A is a representation of a dipole antenna oriented along the z-axis. FIGS. 9B, 9C, and 9D show prior art radiation patterns for the antenna of FIG. 9A.

FIG. 8B shows a radiation pattern 810 for the orthogonal polarization (dashed line) for the x-y plane. There is negligible radiation (not shown) in the parallel polarization for the x-y plane. FIG. 8C shows the radiation pattern 820 for the orthogonal polarization for the y-z plane. There is negligible radiation (not shown) in the parallel polarization for the y-z plane. FIG. 8D shows the radiation pattern 830 for the parallel polarization (solid line) for the x-z plane. There is negligible orthogonal polarization (not shown) in the x-z plane.

FIG. 9B shows a radiation pattern 910 for the orthogonal polarization (dashed line) for the x-y plane. There is negligible radiation (not shown) in the parallel polarization for the x-y plane. FIG. 9C shows the radiation pattern 920 for the parallel polarization (solid line) for the y-z plane. There is negligible radiation (not shown) in the orthogonal polarization for the y-z plane. FIG. 9D shows the radiation pattern 930 for the parallel polarization (solid line) in the x-z plane. There is negligible orthogonal polarization (not shown) in the x-z plane.

Again, comparison of the graphs 7A, 7B, 7C to graphs 8B, 8C, 8D and 9B, 9C, 9D, shows the improvement in coverage achieved by the microstrip antenna 300 formed in accordance with the preferred embodiment of the invention.

Patches of different sizes and shapes coupled together on opposite surfaces of the ground plane 322 may also be used in certain applications with tight space constraints, though the radiation patterns may vary.

The following steps summarize the method through which the antenna structure 300 is formed in accordance with the present invention. First, a substrate having an inner layer ground plane is provided. Second, in accordance with the invention, first and second radiator patches, preferably quarter wavelength patches, are formed over opposing sides of the ground plane. The quarter wavelength patches can be individual patches joined along one edge of the substrate, through one of many available coupling means such as capacitive coupling, vias, pins, conductive paint, soldering, to name but a few. Alternatively, a single patch can be folded about the edge so as to form two quarter wave patches over opposing surfaces of the ground plane. Thus, a single radiator element is provided which provides improved spherical coverage. A radio frequency (RF) feed is provided to one of the quarter wavelength patches to feed a radio frequency signal to the antenna. Alternatively, a second RF feed can be coupled to the other quarter wavelength patch.

Figure 10:
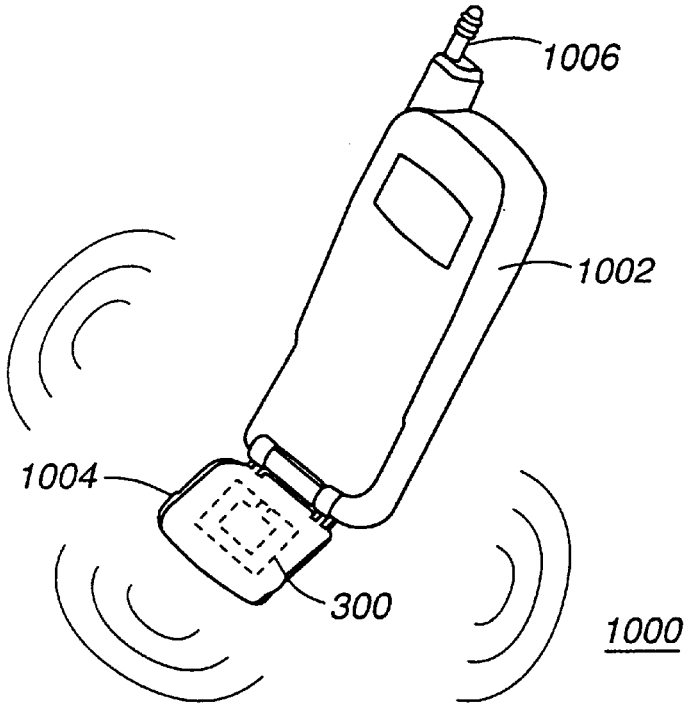
FIG. 10 is a radio incorporating the antenna of the present invention.

FIG. 10 shows a communication device, such as a radio or cellular telephone 1000, incorporating the antenna 300 described by the invention. Radio 1000 comprises a housing 1002 and a flap 1004 coupled to the housing. Coupled to the flap 1004 is microstrip antenna 300 described by the invention and shown in phantom. The antenna 300 provides improved spherical radiation which enhances coverage for the user. Antenna 300 of the present invention can also be used in conjunction with a second antenna 1006 for diversity if desired.

Figure 11:
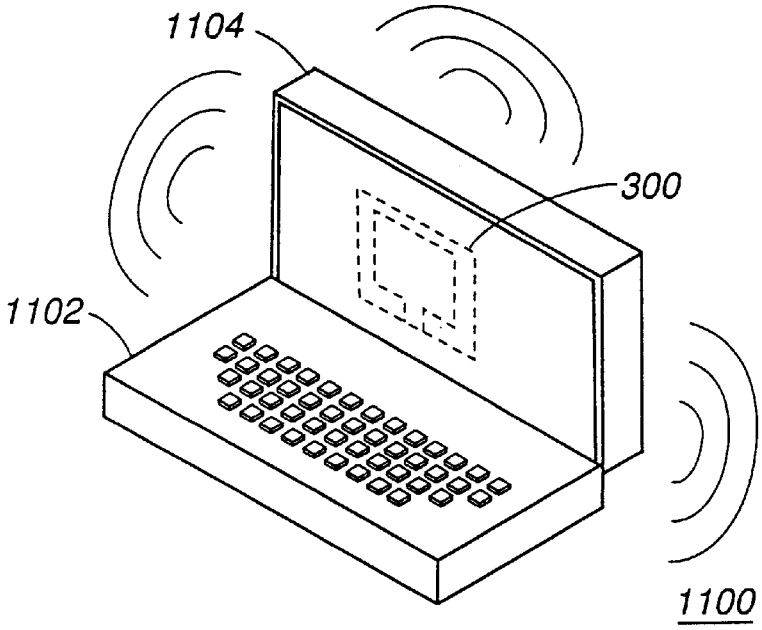
FIG. 11 is a computer incorporating the antenna of the present invention.

The antenna 300 described by the invention can be used in a wide variety of applications where broad antenna coverage is desired in a small space. For example, the antenna 300 could be used in the lid of a wireless computer. FIG. 11 shows a wireless computer 1100 incorporating the antenna 300 described by the invention. Computer 1100 includes a housing 1102 and a lid 1104 coupled to the housing. Coupled to the lid 1104 is the microstrip antenna 300 described by the invention and shown in phantom. The antenna 300 described by the invention provides omni-directional radiation coverage wrapping around the computer in both the azimuth plane (tangent to the earth's surface) or the elevation plane (perpendicular to the earth's surface). The antenna 300 described by the invention need not be placed perpendicular to the plane of the lid, as would a loop antenna, in order to achieve optimum performance. Thus, the antenna 300 achieves spherical radiation performance while being much less intrusive than the loop antenna.

Besides being placed on portable devices, the antenna described by the invention can also be implemented in infrastructure equipment, such as repeaters and base stations. Flush mounting the antenna described by the invention in thin walls or ceilings of building provides increased options for personal communications systems. Further, the large cross polarization fields of the antenna described by the invention is beneficial for areas within building having unpredictable electromagnetic field distributions.

Accordingly, the antenna configuration described by the invention provides a microstrip antenna which is particularly well suited for applications having strict size constraints. The thin profile combined with omni-directional radiation in its principal planes and dual polarization response make the antenna described by the invention useful for a variety of applications.

While the preferred embodiments of the invention have been illustrated and described, it will be clear that the invention is not so limited. Numerous modifications, changes, variations, substitutions, and equivalents will occur to those skilled in the art without departing from the spirit and scope of the present invention as defined by the appended claims.

What is claimed is:

1. A microstrip antenna, comprising:

a substrate having top, bottom, and edge surfaces and an inner ground plane layer; and a radiator element folded about the edge of the substrate so as to form first and second patches on either side of the ground plane on the top and bottom surfaces of the substrate.

2. A microstrip antenna, comprising:

a substrate having top, bottom, and edge surfaces and an inner ground plane layer; and a radiator element folded about the edge of the substrate so as to form first and second quarter wavelength patches on the top and bottom surfaces of the substrate on either side of the ground plane, the radiator element providing the characteristics of a loop antenna and a dipole antenna so as to generate a substantially spherical radiation pattern.

3. A communication device, comprising:

a housing;

a microstrip antenna coupled to the housing, the microstrip antenna comprising:

a substrate having top bottom and edge surfaces and an inner ground plane layer; and first and second radiator patches disposed on the top and bottom surfaces of the substrate over opposed surfaces of the ground plane layer, the first radiator patch coupled to the second radiator patch along one edge of the substrate.

4. A communication device as described in claim 3, wherein the first and second radiator patches comprise first and second quarter wavelength patches respectively.

5. A communication device as described in claim 3, wherein the first and second radiator patches are coupled through capacitive coupling.

6. A communication device as described in claim 3, wherein the first and second radiator patches are coupled through conductive paint.

7. A communication device as described in claim 3, wherein the first and second radiator patches are coupled through vias.

8. A communication device as described in claim 3, wherein the first and second radiator patches are coupled through conductive pins.

9. A communication device as described in claim 3, wherein the first and second radiator patches are formed from a single half wavelength patch folded about the edge surface.

10. A communication device as described in claim 3, wherein the housing comprises a radio.

11. A communication device as described in claim 3, wherein the housing comprises a computer.

* * * * *

UNITED STATES PATENT AND TRADEMARK OFFICE

CERTIFICATE OF CORRECTION

PATENT NO. : 6,195,051 B1
APPLICATION NO. : 09/548486
DATED : February 27, 2001
INVENTOR(S) : Danny McCoy It is certified that error appears in the above-identified patent and that said Letters Patent is hereby corrected as shown below:

ON THE COVER PAGE:

Item (62) after, Division of application No., delete "09/287,900" and insert --09/287,990--.

Signed and Sealed this
Nineteenth Day of June, 2012

David J. Kappos

David J. Kappos
*Director of the United States Patent and Trademark Office*